US005123870A

United States Patent [19]

Cahill

[11] Patent Number: 5,123,870

[45] Date of Patent: Jun. 23, 1992

[54] DOLL FACE AND HEAD FEATURING FUSIBLE ADHESIVE AND AN APERTURED BATTING MODULE

[76] Inventor: Mary J. Cahill, 6292 Marlborough Ave., Goleta, Calif. 93117

[21] Appl. No.: 310,053

[22] Filed: Feb. 13, 1989

Related U.S. Application Data

[63] Continuation of Ser. No. 828,329, Jan. 17, 1986, which is a continuation-in-part of Ser. No. 662,839, Oct. 19, 1984, Pat. No. 4,629,441, and Ser. No. 610,959, May 16, 1984.

[30] Foreign Application Priority Data

May 14, 1985 [WO] PCT Int'l Appl. ... PCT/US85/00872

[51] Int. Cl.[5] ..... A63H 3/02; A63H 3/36

[52] U.S. Cl. ..... 446/372; 446/385

[58] Field of Search ..... 446/372, 368, 370, 369, 446/373, 374, 375, 385, 387, 398, 395, 394, 393, 392

[56] References Cited

U.S. PATENT DOCUMENTS

| | | | |
|---|---|---|---|
| 1,442,761 | 1/1923 | Beach | 446/372 |
| 1,916,811 | 7/1933 | Schwartz | 446/372 X |
| 3,848,281 | 11/1974 | Mathews | 5/436 |
| 4,112,614 | 9/1978 | Clokey | 446/391 X |
| 4,591,521 | 5/1986 | Freno et al. | 446/372 X |
| 4,629,441 | 12/1986 | Cahill | 446/372 |
| 4,840,603 | 6/1989 | Cahill | 446/391 X |

FOREIGN PATENT DOCUMENTS

| | | | |
|---|---|---|---|
| WO85323 | 12/1985 | PCT Int'l Appl. | 446/369 |
| 8808321 | 11/1988 | PCT Int'l Appl. | 446/391 |
| 488434 | 7/1938 | United Kingdom | 446/391 |

*Primary Examiner*—Robert A. Hafer
*Assistant Examiner*—D. Neal Muir
*Attorney, Agent, or Firm*—Poms, Smith, Lande & Rose

[57] ABSTRACT

The doll is formed by outlining a desired feature with an adhesive such as either a meltable, fuser thread or a sheet of fuser material with cutouts in the shape of the desired feature between a stretchable front and a non-stretchable rear piece of fabric. Soft material is inserted between the two sheets within the feature such as through the top of the U-shaped nose opening and through a slit in the rear piece of fabric behind the mouth. The mouth can also be formed by satin-like stitches. The lips can also be formed by running stitches forming an outline, which is then filled. Satin-like stitches then cover the protruding lips. Small heat fusible adhesive disks create the eyes. Inset eyes may be formed by placing a length of thick, elongated material, such as a cord, around the attached region and sewing the ends of the cord together. The area between the outline of the thick, elongated fabirc is inset from the raised outline of the thick, elongated material. Stitching the front and rear sheet together next to the nose may also create eyes. The space between the two sheets at the forehead, cheeks and chin is then filled with more soft material, or a batting module with a central opening may surround the features between the sheets. The front and rear sheets of material are sewn together, the face portion is attached to a back head portion, and the cavity between them is filled with soft material. The eye locations are stitches with long stitches extending through the back piece and pulled tightly to indent the eyes.

10 Claims, 6 Drawing Sheets

DOLL FACE AND HEAD FEATURING FUSIBLE ADHESIVE AND AN APERTURED BATTING MODULE

RELATED APPLICATIONS

This application is a continuation of applicant's prior application, Ser. No. 828,329 filed Jan. 17, 1986, which was a continuation-in-part of applicant's previous U.S. patent application Ser. No. 662-839 filed Oct. 19 1984 and now U.S. Pat. No. 4,629,441 dated Dec. 16, 1986, and was also a continuation-in-part of applicant's U.S. patent application Ser. No. 610,959 filed May 16, 1984.

BACKGROUND OF THE INVENTION

1. Field of the Invention

The present invention relates (a) to a method for producing three-dimensional facial features on a soft cloth doll, and (b) to the doll produced by the method. The method also has applicability for making three-dimensional features in cloth other than dolls.

2. The Prior Art

Soft cloth dolls have been made for centuries. Many methods have been developed to produce facial features. All construct the basic head by filling a spherical, ellipsoidal or other similar shaped head cavity made of cloth with a soft substance such as down or fabric. The methods fall within three categories.

a. Applique and Embedment: Both methods rely on stitching or adhering objects such as buttons, felt scraps, small stuffed and stitched bags, etc., directly on top of (in the case of applique) or embedding them under (in the case of embed) a seamless facial covering cloth. For example, some cloth dolls apply a button to the front surface. It is ornamental but artificial. This method has limited results because of the unnatural shape of the embedded or adhered object. Schwartz, U.S. Pat. No. 1,916,811 (1933) is an example of applique.

A variation uses pieces of polyester fiberfill and batting glued to a sheet of non-stretch muslin to form gross features (e.g., a forehead, nose, mouth and cheeks). The muslin and the soft material are covered by a sheet of stretch polyester, and the fiberfill and batting create gross features. Long stitches can also be pulled completely through the head to provide indentations for the eyes. Use of stitches extending through the head is disclosed in Sanders, U.S. Pat. No. 2,483,325 (1949) and Beach, U.S. Pat. No. 1,442,761 (1923). The faces are interesting, but the features are not sharp and lifelike because the materials used to form the features cannot be properly confined. Therefore, when the head cover is tightened, the features flatten.

(b) Needle Modeling: The head is also formed by filling with a soft material an approximately spherical or ellipsoidal enclosure of sheer material. The cloth is stitched and tucked into the filling material in such a way as to form three-dimensional features. This method is discussed in Foster, *Foster Children Soft Sculpture Dolls*, (1982). The effects can be lifelike, but the stitches are visible to the unaided eye and are aesthetic distractions. If the material is sheer, the head and face has little mechanical durability and can easily be damaged by rough handling. The features formed are less clearly defined if thicker materials are used.

(c) Trapunto: A feature such as an ear is formed by stitching an outline in front and rear cloth pieces, which also holds the cloth together. Material is stuffed within the outline between the front and rear pieces to form a protruding feature. The method is usually unsatisfactory because the stitches are visible.

(d) Seamed Heads and Faces: This method uses two or more pieces of pattern material, joined together by stitches to form the head cavity. In the center seamed face, a popular example of this method, a flat pattern is used for cutting two identical side profiles of the head. Each profile has a nose, chin, etc. The profiles are then stitched together with a seam running through the center of the face to create a head cavity, which is then filled with soft material. The seams, which appear directly on the surface of the face, are the main drawback in this system.

Each of the described methods can be used alone or in combination, but they all suffer from an inability to form clear, lifelike facial features without distracting stitches on the facial surface. Experts in the field have lamented these drawbacks.

There are some other methods which do not appear to have gained lasting acceptance and are not strictly soft cloth dolls. Walker, U.S. Pat. No. 144,373 (1873) produced facial features pressed from cloth saturated with glue. Wellington, U.S. Pat. No. 285,448 (1883) uses a wire frame inside of the head. Johnson, U.S. Pat. No. 366,730 (1887) used waxed cloth as the base material. Other materials such as tar, paint, pressed felt and cardboard have also been used either to stiffen the material to form a harder mask or to create a mechanical foundation over which cloth is stretched. None are soft to the touch, and most are mechanically weak and require technical capabilities often not found in the home.

It is especially difficult to obtain a desirable doll face or head in a production setting. The hobbyist may not want her doll to look exactly like another hobbyist's doll, but manufacturing quality control requires repeatable results.

SUMMARY OF THE INVENTION

The present invention relies on several new methods for creating well defined cavities into which material can be added to create facial features. As in earlier methods, the face is formed with two face pieces of cloth, one of stretch fabric and the other which does not stretch. The rest of the head is formed using a third piece of cloth such that the two face pieces and the rear piece form a spherical or ellipsoidal head that is filled with soft material. The methods form features without showing stitching on the doll face.

In one form of the method, an adhesive holds the two face pieces together. The adhesive is placed in the desired outline of the facial feature to create a separate cavity. If part of the feature is open between the two face pieces, soft material can be inserted into the cavity through the open region between the front and rear face pieces. If the feature has no opening, an opening is made in the rear face piece to allow the soft material to be pushed into the cavity outlined by the adhesive. The exemplary embodiment of this method uses a fuser thread of polyamide or similar substance as an adhesive. The thread is laid out in the defined shape between the two sheets of the face. When heat is applied, the thread fuses the two sheets together along the pattern to create the cavity for stuffing. The fusing holds the two sheets together in a strong manner that is not damaged from rough handling. If the fuser thread is used to define the nose, the strength is enhanced because of strong anchoring in the eyes and mouth areas around the nose that limits the movement of the fabric adjacent the fused outline.

Other features such as the mouth can be formed by the same technique. The present invention, however, uses two new methods to create a three-dimensional mouth that also looks embroidered or which is covered by embroidery. This embroidered look is obtained with a stitch similar to a satin stitch but is raised and greatly projected from the surface of the cloth. The outline of the lip is first determined and then using needle and thread, the needle first passes through the fabric toward the outside at the outline of the lip and then the needle is located at the vertically opposite side of the outline of the lip and passed through the fabric toward the inside sheet. The needle is then pulled back through the fabric. Then the needle point is placed adjacent to the thread that has just passed to the inside. Now the needle for a second time passes through the fabric toward the outside so as to repeat the process. As a result, there are now two long, vertically parallel segments of thread running from the top of the lips and then back to the bottom of the lip to create a special satin stitch. As this process is repeated, an embroidery-like pattern is created of parallel threads on the outside piece of fabric with the space between the outline of the lips along the rear piece of fabric being open. A slit is made in the rear piece of fabric between the mouth outline, and soft stuffing material is pushed through the slit to make the mouth three-dimensional and covered by the embroidery-like satin stitch. Rather than having the threads run from the top and bottom of the mouth to the center to form lips, they can run from the top of the mouth to the bottom to create a single mouth.

In an alternative embodiment, which provides lips that are very greatly raised from the facial surface, the lips are outlined using stitches as in the trapunto technique. After the lips are filled as in the previous method, the special satin or embroidery stitch is applied over the projecting lips. These stitches cover the stitches that created the outline of the lips.

After the nose and mouth are formed, the remaining areas between the front and rear pieces are filled with some soft material. The two face pieces are integrated with a back piece to form the head, which is filled with soft material. An additional, stiffer piece of canvas-like material can be inserted into the head for rigidity. Long stitches pass from the eye location through the soft material and through the back piece of fabric that forms the back of the head. When these stitches are tightened, the eye locations are pulled back to create a natural indentation. Although the eye stitching will be visible, the stitching itself can be used to form the highlights of the eye such as a reflection or the pupil itself. The remaining decoration of the eye is painted.

Improved eyes which simplify assembly of the head and enhance the mechanical stability of the face can be achieved by adding heat fusible material such as polyamide in the shape of a disk. Such disks are placed on the rear piece of fabric in a position corresponding to the location of the eye. The front sheet then covers the heat fusible disk, and the disk is melted by heating the fabric with an iron. When the adhesive cools and sets, the front and rear pieces of fabric are held together at the eye region.

To form an inset feature, one then encircles each of the eyes between the rear sheet and the front sheet of fabric, with a relatively thick piece or cord of cotton, synthetic or other material. The ends of the cord are sewn together, and the area that the adhesive holds together traps the cord. The cord causes the front piece of fabric, which can stretch, to bulge, but the adhesive recesses the area inside the outline of the cord. The protrusion corresponds to the bony structure around the eye socket, and the inset structure corresponds to the eye itself.

Rather than employing unformed, soft stuffing material to fill the remaining spaces between the two face pieces, a batting module may be provided with a central cutout having space for the eyes, nose and any other features.

In still another embodiment, rather than laying out polyamide threads in a desired pattern, sheet polyamide can be used of the approximate size of the front and rear piece of fabric. The sheet of polyamide or other fuser material has cutouts where soft stuffing can be added. For example, a sheet of polyamide could have cutouts for the eyes, nose, mouth, cheeks, eyebrows, chin and any other part where there is to be filling added. With proper techniques, the sheet polyamide can be cut with very fine patterns so that eye details, for example, could be shown. The sheet polyamide is laid on the rear piece of material, the front piece of material is then laid over the sheet polyamide and the material is fused. After fusing, areas where there is no polyamide are filled with soft material.

BRIEF DESCRIPTION OF THE DRAWINGS

FIG. 8 is similar to FIG. 7 but shows how the eye locations are indented by long threads.

Figure 15:
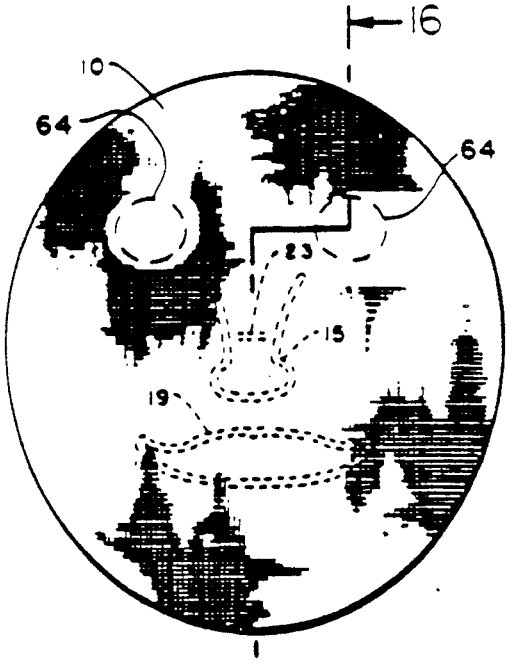

14 shows the face with the parts to make the inset feature, and FIG. 15 only shows the adhesive disks.

Figure 16:
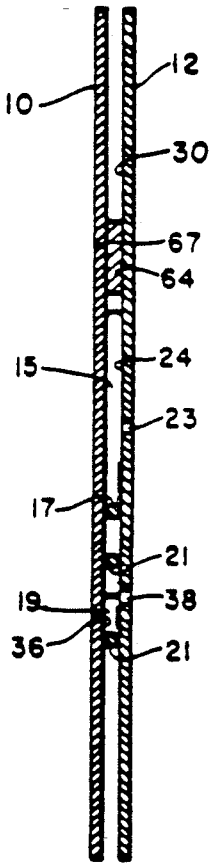
Figure 17:
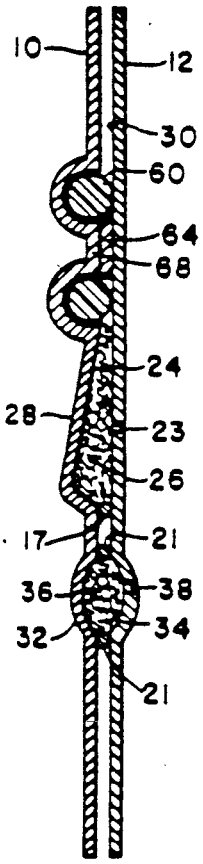

FIGS. 16 and 17 are cross-sectional views of the doll face of this alternative embodiment of the present invention. FIG. 16 is taken through plane 16—16 in FIG. 15, and FIG. 17 is taken through plane 17—17 in FIG. 14.

Figure 18:
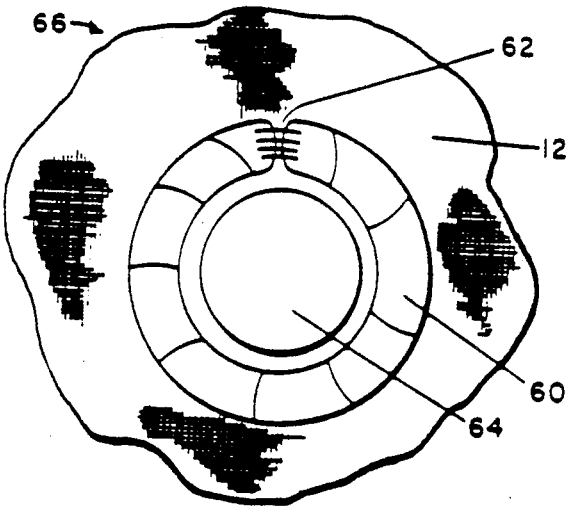

FIG. 18 is a front view showing the detail of the structure that forms the inset feature, which is placed around the fused area.

Figure 19:
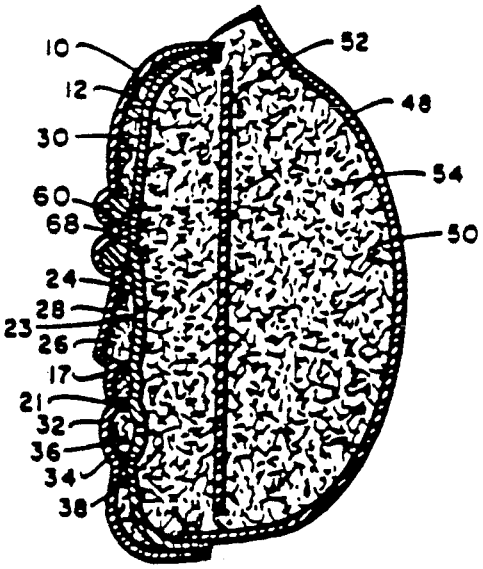

FIG. 19 is a sectional view of the face of the present invention incorporated into a doll's head.

Figure 20:
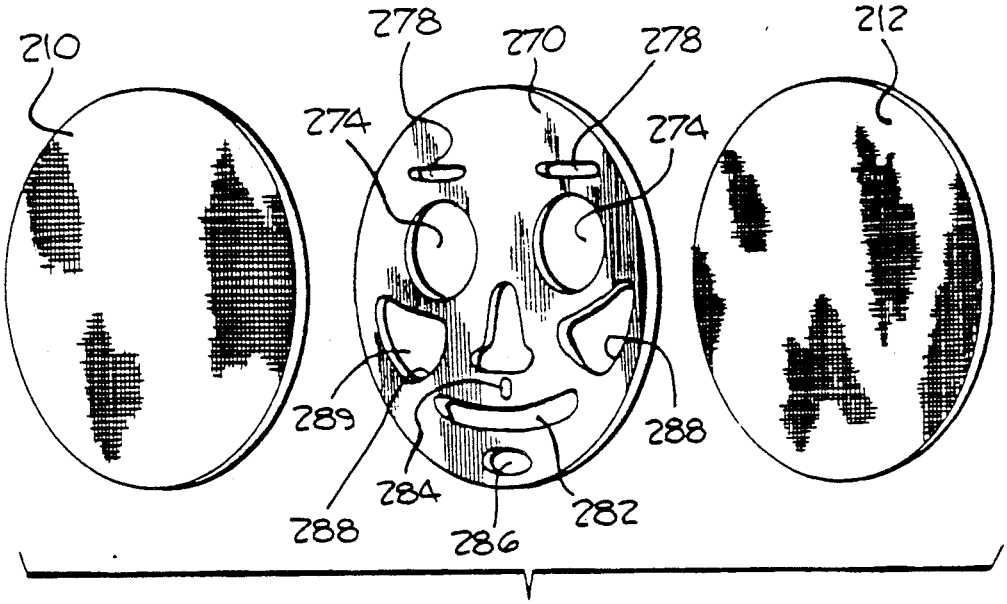

FIG. 20 is an exploded view of the front and rear pieces of fabric in another embodiment of the present invention with a sheet of polyamide having cutouts to form outlines for features of the face.

Figure 13:
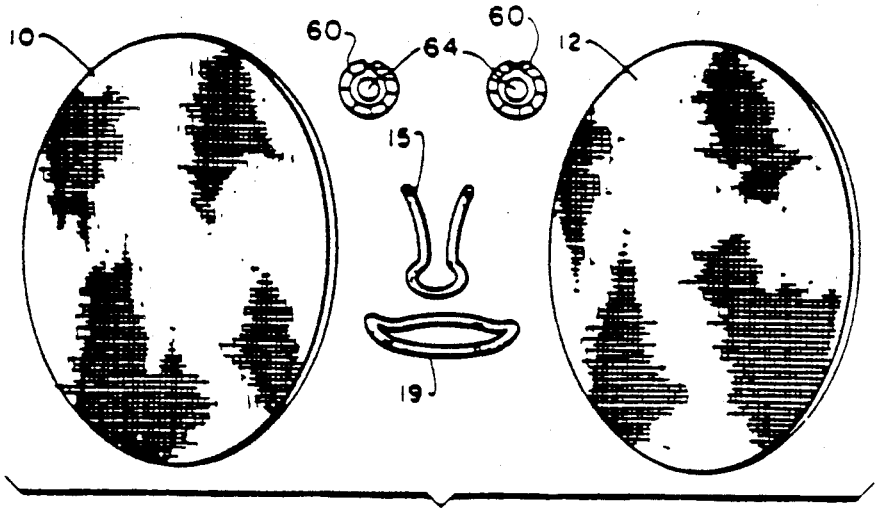
FIG. 13 is an exploded view of the front and rear pieces of fabric with fuser threads used to form outlines of the mouth and nose and the structures forming inset eyes in this invention.
Figure 21:
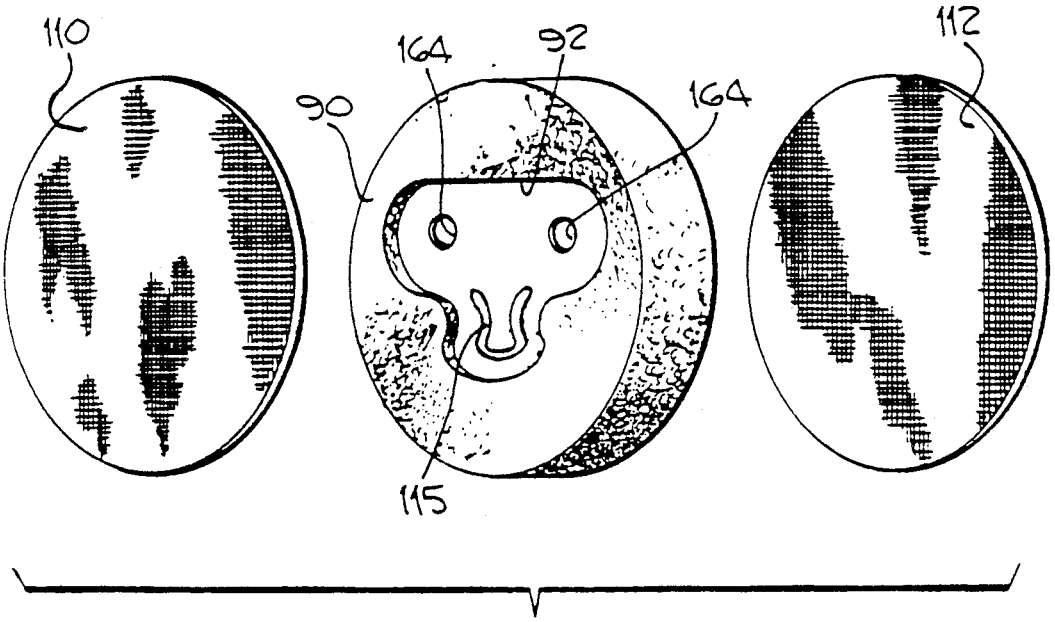

FIG. 21 is an exploded view of the front and rear pieces of fabric similar to FIG. 13 but with a module of soft filler material or batting around the fuser threads used to form feature outlines.

DETAILED DESCRIPTION OF THE PREFERRED EMBODIMENTS

The present method uses two pieces of fabric for forming the face of the doll. The first, front piece 10, and the second, rear piece 12 (FIGS. 1, 5, 20 and 21), may be of any type of cloth depending on the color and texture objectives of the maker. As will be explained below, features protrude more if the front piece 10, which will be the outside, visible piece (FIG. 12), is stretch fabric while the rear or inner cloth 12 does not stretch. Additionally, the facial structure is more mechanically stable if the inner cloth is non-stretch. Both sheets 10 and 12 are elliptical or oval.

Figure 1:
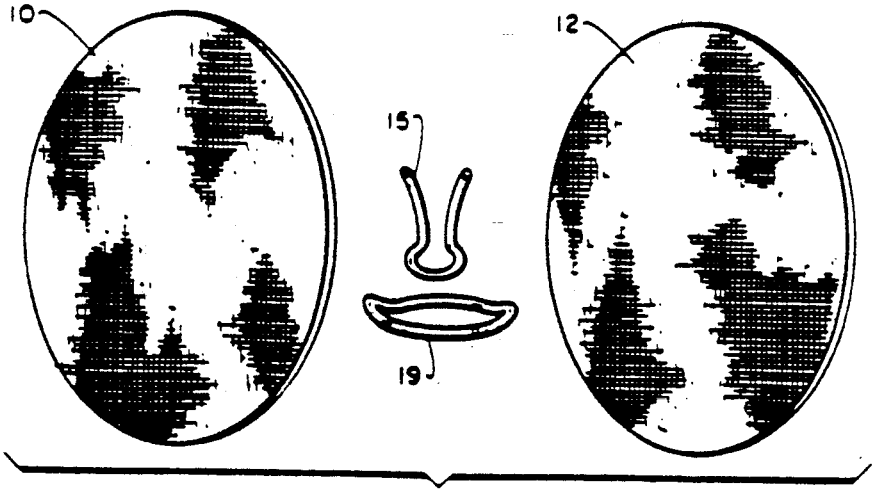
FIG. 1 is an exploded view of the front and rear pieces of fabric in one embodiment of the present invention with fuser thread used to form outlines of the mouth and nose.
Figure 2:
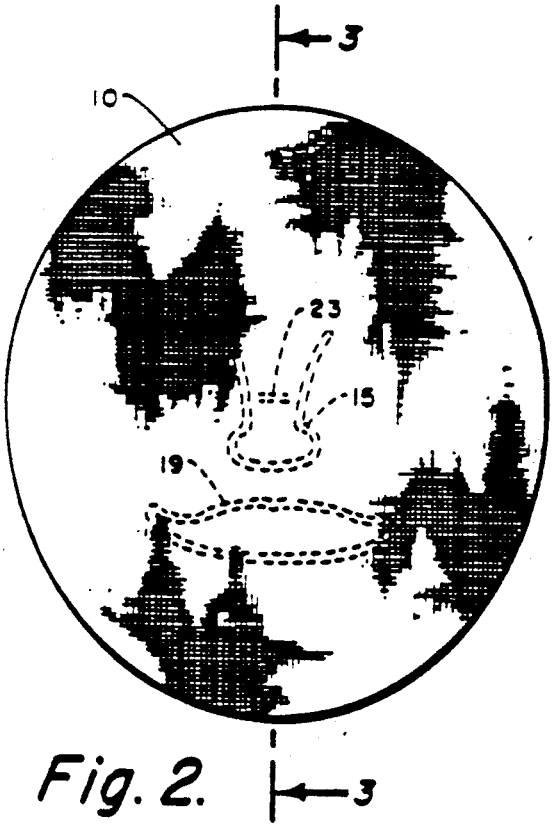
FIG. 2 is a front view showing one embodiment of the present invention.
Figure 3:
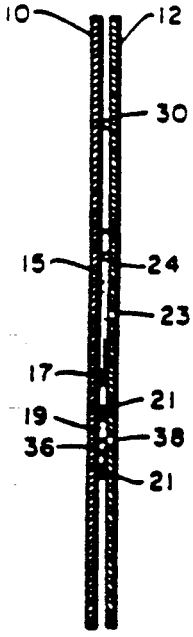
FIGS. 3 and 4 are both cross-sectional views taken through plane 3—3 in FIG. 2. Cavities formed by the fuser thread of the exemplary embodiment, which are empty in FIG. 3, are filled in FIG. 4.
Figure 4:
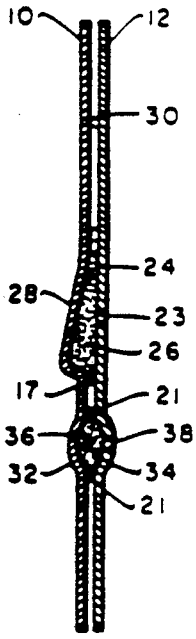

In the embodiment of FIGS. 1 through 8, the nose and mouth are formed in a similar fashion. The construction of the nose is discussed first. The two sheets of fabric 10 and 12, which are approximately the same size, are placed over each other. A desired outline shape for the nose is chosen, and a short piece of fuser thread 15 is made to conform to the desired outline and placed between sheets 10 and 12 at a desired location for the nose, generally near the center of the sheets (FIG. 2). Fuser thread 15 is formed of a polyamide or similar substance, which can be made to conform to any desired shape when it is placed on rear sheet 12. When front piece 10 is placed over rear sheet 12 and fuser thread 15, the thread can be heated using a clothing iron or other similar device. After several seconds, the fuser thread melts and flows into and around the cloth fibers to create a fine fused seam 17 (FIGS. 3 and 4). Likewise, another piece of fuser thread 19 can form the outline of the mouth (FIG. 2), and it can then form hidden, fine fused seams 21 (FIGS. 3 and 4) after it is melted in a similar fashion.

A fuser thread is used because it is easily controlled for adjusting the shape of the features. Only when the feature is in the exact desired shape is heat applied and the final attaching finished. Adhesives that are not set by heating can also be used, but the adhesive used should be strong and water resistant.

Fuser thread 15, which forms the nose, is placed in a pattern with an opening at the top (FIGS. 1 and 2). The cavity 24 (FIGS. 3 and 4) formed between the front and rear pieces as outlined by the fuser thread 15 is filled with soft material through the opening at the top of the nose. This makes the nose natural in that cavity 24 flows into forehead space 30 (FIGS. 7 and 8), which is also between pieces 10 and 12 and which can also be filled with material to make the forehead. Cheeks (not shown) can be formed to the sides of the nose in a similar fashion.

Instead of filling the nose through the top opening as shown in FIGS. 2 and 3, a small horizontal (FIG. 2) or vertical slit 23 can be cut into rear piece 12 within the outline of the nose feature formed by fuser thread 15. Once slit 23 is formed, pocket or cavity 24, which is formed within the outline of seam 17, is filled with soft material such as down 26. As shown in FIGS. 4 and 6 through 8, filled cavity 24 becomes the nose 28 (FIG. 8). For nose 28 to protrude properly, front piece 10 should be of a stretch material, but it is best if rear piece 12 does not stretch so it exerts proper force on filling 26.

Figure 6:
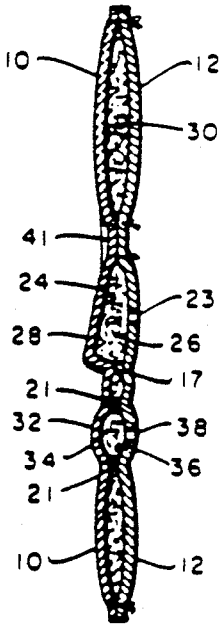
FIG. 6 is a sectional view of the face of FIG. 5 taken through plane 6—6 in FIG. 5.
Figure 7:
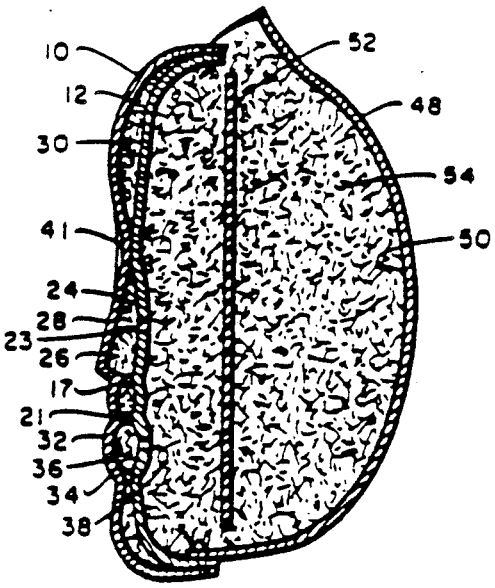
FIGS. 7 and 8 are side, sectional views of the head showing the two filled face pieces attached to the rear head piece. The entire head cavity is filled with soft material.
Figure 8:
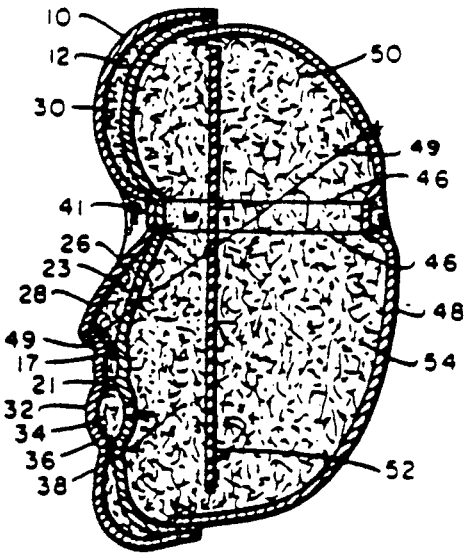

In the first exemplary embodiment, mouth 32 is formed similarly in that soft filling material 34 (FIG. 4) is inserted through slit 38 into cavity 36 between seams 21 made by fuser thread 19 (see also FIGS. 6, 7 and 8).

Using a single outline for the mouth as shown in the exemplary embodiment does not yield separate lips. Painting the central portion of the mouth to create an illusion of separate lips, however, may be acceptable. If not, an additional piece of fuser thread (not shown) can be placed horizontally extending to or near both corners of the mouth. Two cavities are then formed, one for each lip, and are filled using the same techniques.

The eyes are next created either by embroidering eye designs or painting the designs at the desired location. Realistic eyes 41 and 41 (FIG. 12) have a white portion 42 and are colored light at iris 43 and dark at pupil 44. Each also has a lighter reflection highlight 45 (FIG. 12), which gives an aesthetic and natural look to each eye. Stitches through the eyes also strengthen the face and help to hold the front and rear pieces 10 and 12 together. Dark stitching can go through or form pupil 44, and light stitching can be used to create highlights 45.

As an alternative, the eyes can be formed as follows. A small area 64 of an adhesive is placed in the desired location on rear sheet 12 (FIG. 15). Although many types of adhesive may be used, the present invention contemplates using a disk of fuser material such as polyamide or similar substance. Next, the top sheet of stretchable material 10 is placed over fabric 12 and disk 64. When heat is applied to the back of fabric sheet 12 or to the top of sheet 10 (e.g., with an iron), the fusing material melts, and when it cools, it holds region 67 together (FIG. 16).

When the face is formed (see FIG. 19), the outside peripheries of the lower half of the face pieces 10 and 12 are stitched together forming a pocket. Soft material, such as down or fiberfill, fills this large pocket so that a chin, cheeks and forehead naturally appear (FIG. 19). The eyes add mechanical strength to the upper portion of the face and trap the filling that forms the forehead and cheeks. In prior art dolls, there is a tendency for the facial features to "drift" relative to each other when the head is stuffed. The features, which are anchored to non-stretch rear fabric 12 in this invention, have no such tendency.

Figure 14:
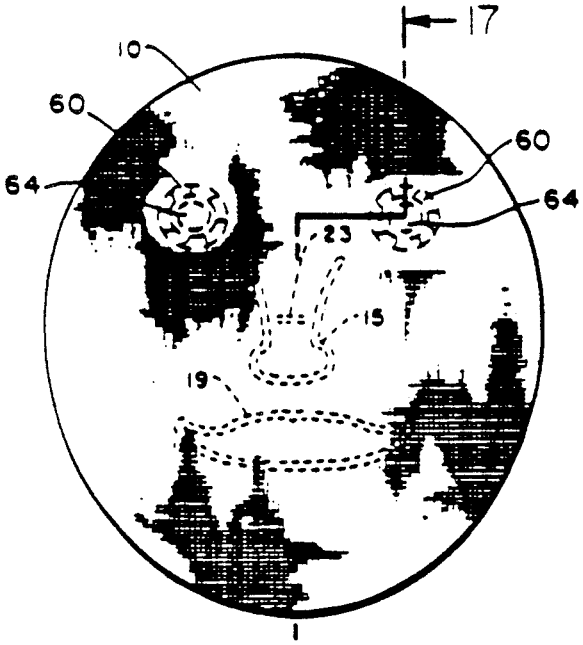
FIGS. 14 and 15 are front views of the doll face of the alternative embodiment of the present invention. FIG.

To form the inset features, a piece of thick, elongated fabric is made to surround the feature, the eyes in this case. Referring particularly to FIGS. 17 and 18 in the exemplary embodiment, once area 64 of an adhesive is fused (as in FIGS. 15 and 16) and holding region 67 between sheets 10 and 12 together, a thick, elongated piece of material 60 is placed in a desired pattern around region 67 (FIGS. 13 and 14). Ring 66 (FIG. 18) is one such pattern. The thick, elongated material may be a rope or cord and may be of cotton, hemp or synthetic material. The ends of member 60 are sewn together at 62 to form ring 66. The ring causes top sheet 10 of stretch fabric to bulge above disk 64 (FIG. 17). The rear sheet 12, which does not stretch, supports the ring so that the bulge extends primarily from the front sheet. As FIGS. 17 and 19 show, the rope-like material 60 protrudes outward making it appear as if it were the skeletal structure surrounding an eye. The inset portion 68 corresponds to the way in which the eye is inset from the protruding skeletal structure of the face.

Alternatively, one could use a ring-like member that would be similar to member 60 in its sewn-together ring shape 66 of FIGS. 17 and 18. The adhesive disk would be placed in the ring between the two sheets 10 and 12. Fusing next takes place, but in this modification, fusing is made more difficult.

Figure 5:
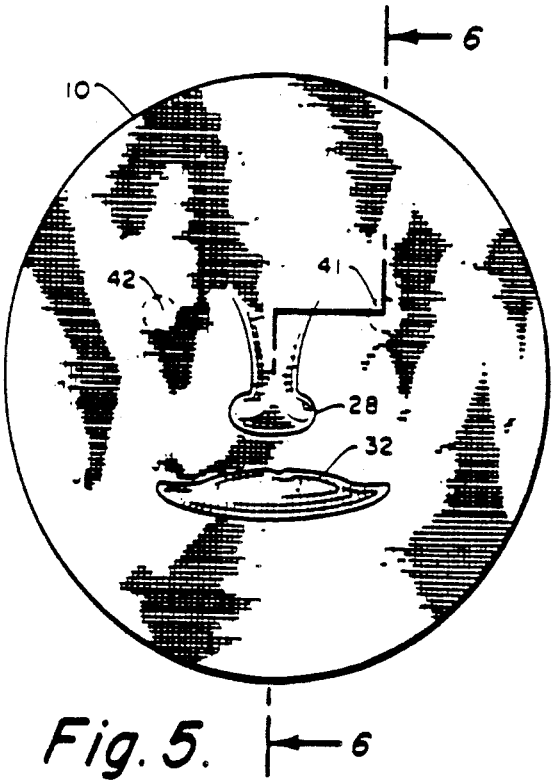
FIG. 5 is a front view of the face in one embodiment of the present invention in which the nose and mouth features are filled and some filling is added to the forehead and chin.

The face is now in a condition to be finished and incorporated into the doll head. The face is held together at both eyes, the nose and the mouth. The outside peripheries of the lower half of the face pieces 10 and 12 are now stitched together forming a pocket. Soft material, such as down or fiberfill, fills this large pocket so that a chin, cheeks and forehead naturally appear (FIG. 5). The top peripheries of the front and rear pieces 10 and 12 are then stitched, and the face is completed.

Either the first or second principal embodiments can be modified slightly with the embodiment shown in FIG. 21. Eye disks 164, thread 115 for the nose and possibly a thread for the mouth fuse front piece 110 to rear piece 112. A batting module 90 of soft filler material is placed on rear sheet 112 by pulling the edges of front piece 110 through opening 92 in the batting. The nose or other features are filled before inserting the batting module. Pieces 110 and 112 are then sewn together. Although FIG. 21 shows a flat, oval batting module, certain areas such as the cheeks could be made somewhat thicker by cutting an irregularly shaped module. Portions of this module may extend beyond the periphery of the inner and outer pieces 110 and 112, and can be folded into the inner and outer pieces before sewing the periphery.

The embodiment in FIG. 21 would be useful in production because batting modules could be prepared by machine and automatically or manually positioned in the proper location in a machine. Automation could also be enhanced by use of the embodiment shown in FIG. 20. There, rather than having polyamide thread or disks define the features as in other embodiments, cutouts in a sheet of polyamide are used. The sheet upon fusing holds the front and rear pieces together, but the cutouts, where there is no fuser material, can be filled. Moreover, the periphery of the sheet of polyamide fuser material can also seal the periphery of the front and rear pieces of fabric 10 and 12 (e.g., FIG. 6) to eliminate the final sewing of the periphery. Even if the face module is completed without stuffing, it can be filled easily at a factory or sold as a kit to a hobbyist who can then use the face. module and fill the cutout areas by making small slits in the rear piece of fabrics at the cutouts.

Turning to FIG. 20, one starts with the same front and rear pieces of fabric 210 and 212. Front piece 210 is preferably of stretch material; rear piece 212 does not stretch. Polyamide or other heat fusible material is available in sheet form, usually on a backing sheet of paper or plastic from which it can be peeled. Openings 274 for the skeleton around the eyes, and eyebrows 278, nose 280, mouth 282, chin 286, cheeks 288 and other facial features 284 are cutout of the sheet. If the embodiment of FIG. 20 is used in a manufacturing situation, the cutout areas can give repeatability to the doll faces. Each one can be identical. On the other hand, using more complex, variable cutting techniques, the shape of each feature can be modified to some degree so that each doll face differs slightly from each other. If the method is used by hobbyists, the sheet of fuser material can have suggesting openings where the hobbyist can cut. She also can use considerable latitude to modify the features.

After the fuser material is placed on rear sheet 212, and after sheets 210 and 212 are fused, small slits may be cut into rear sheet 212 at the opening in the fuser material for stuffing of soft material into the cavities. For example, FIG. 20 shows cavity 288 filled with soft material 289.

One additional advantage of using the sheet of fuser material is that the fuser material also attaches at the periphery of the front and rear sheets 210 and 212 together. Sewing does not have to take place after the features are created.

It is also possible to use this method with the eye ring 60 (FIG. 13). Also, other types of slightly harder material than the soft filler material can be placed within or extending between the openings in the fuser sheet. Whereas ring 60 creates the skeletal structure surrounding the eye, material of different softness and configurations may be used to create the other facial features.

Each of the faces created by these methods is next integrated into the head in the same way the faces made by the other methods are made. The back head piece 48 (FIG. 5) is made of a single piece of material cut into an oval or elliptical shape. Normally, back head piece 48 will be slightly smaller than front and rear pieces 10 and 12 for a smooth chin formation. First, the bottom periphery of the back head piece 48 is sewn to the bottom periphery of the previously sewn together front and rear piece 10 and 12 so that a head cavity 54 is formed. An elliptically shaped piece of embroidery canvas 52 or other rigid yet flexible material is placed in cavity 50 for internal mechanical support for the face. Cavity 50 is then filled with soft material 54 to fill the head. Finally, the rest of the periphery is sewn to complete the head.

The face pieces 10 and 12 are now held together in at least four places, the two eyes, the nose, and the mouth. In the FIG. 20 embodiment, fuser adhesive also holds the face together at the edges. The outside periphery of the lower half of the face piece 10 and 12 are now stitched together in all embodiments except FIG. 20 to form a pocket which is opened at the top but joined at the nose, mouth and eye sockets. Soft material, such as down, fills this large pocket so that a chin, cheeks and forehead naturally appear (FIG. 6). The top periphery of the front and rear piece 10 and 12 are then stitched thus completing the face.

The face is next integrated into the head. The back head piece 48 (FIGS. 7, 8 and 19) is made of a single piece of material cut into an oval or elliptical shape. Normally, back head piece 48 will be slightly smaller than front and rear pieces 10 and 12 for a smooth chin formation. First, the bottom periphery of the back head piece 48 is sewn to the bottom periphery of the previously sewn together front and rear piece 10 and 12 so that a head cavity 50 is formed (FIGS. 7 and 19). An elliptically shaped piece of embroidery canvas 52 or other rigid yet flexible material is placed in cavity 50. Canvas piece 52 generates internal mechanical support for the face, which counters the tendency of such faces to flatten and to lose their lifelike and highly contoured appearance. Cavity 50 is then filled with soft material 54 such as down, cotton or synthetic fiberfill until head cavity 50 is filled to the desired firmness. Lastly, head cavity 50 is closed by finishing the stitching along the top portion of the periphery of the back head piece 48 and the front and rear pieces 10 and 12 (FIG. 8). Much of the stitching of the back piece 48 to the front and rear face pieces 10 and 12 takes place with head cavity 50 inside out so that the stitches and the seam allowances are hidden within the doll's head.

Figure 12:
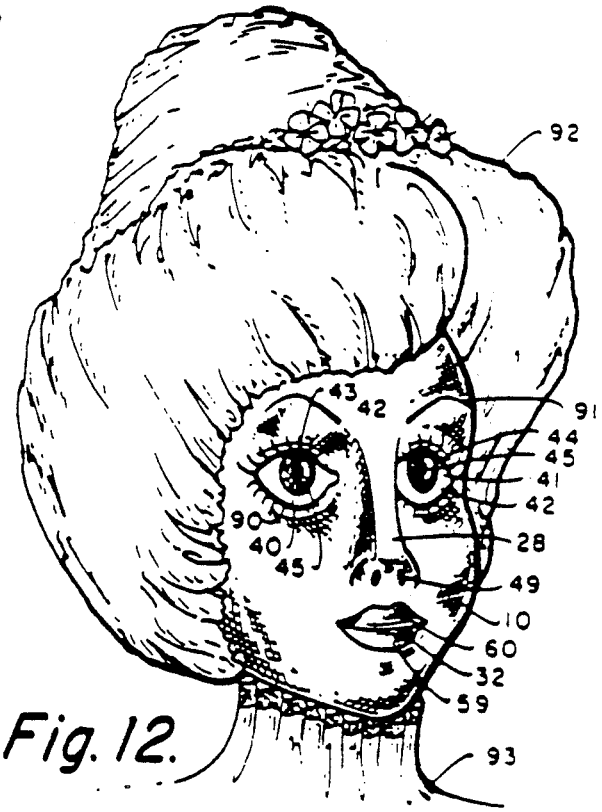
FIG. 12 is a front, perspective view of a decorated doll made using the method of the present invention.

Stitches 46, which help form highlights 45 or pupils 44 in eyes 40 and 41 (FIG. 12), extend through back head piece 48 (FIG. 8) and are pulled tight to make eyes 40 and 41 indent (FIG. 8). For increasing the strength of the nose, one can stitch thread 49 from the base of the nose through the filling to the rear piece 48. These stitches located properly at the bottom of the nose, can look like nostrils (FIG. 12). They do not detract aesthetically from the doll face, but they add to the definition of the bottom of the nose.

Figure 9:
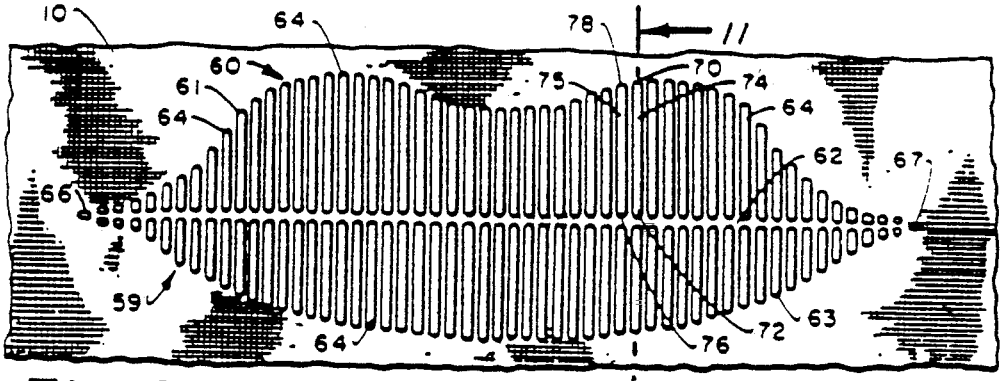
FIG. 9 is a front view showing an alternative method for forming the lips on the doll of the present invention.
Figure 10:
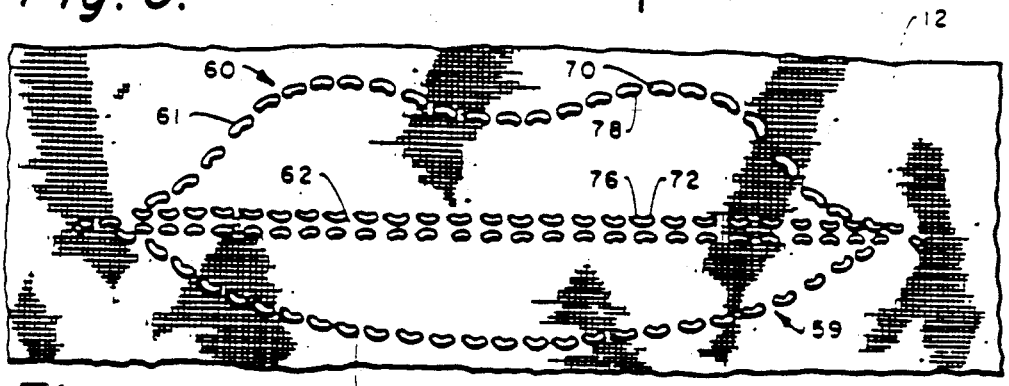
FIG. 10 is a rear view showing the alternative method for forming the lips on the doll of the present invention.
Figure 11:
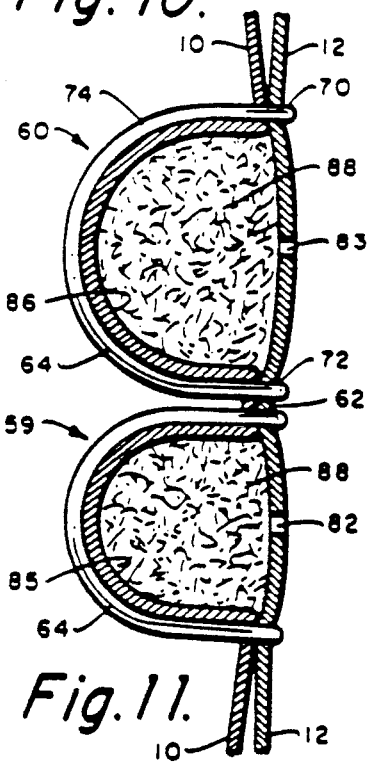
FIG. 11 is a sectional view taken through plane 11—11 in FIG. 9 showing how the lips can be filled to protrude naturally.

The first exemplary embodiment used fuser threads or other adhesives to avoid having stitching on the surface, which would produce aesthetic degradation. Two embodiments form the mouth in an aesthetically appealing way without the use of a fuser thread or other adhesive. FIGS. 9, 10 and 11 disclose embodiments using an embroidery-like technique for lip definition and projection. In the first embodiment, fuser threads 15 and 19 for both the nose and mouth are placed as desired for fusing simultaneously. In the second and third embodiments, it is preferable to form the nose first by fusing. One then fills the nose and stitches the eye sockets.

Formation of the upper lip 60 in the second embodiment is as follows. Long, special satin stitches 64 (FIG. 9) extend vertically across and cover front piece 10 at the upper lip 60 in the following manner. Although one would most likely start in either the left corner 66 or right corner 67 (FIG. 9), the following discussion will start at location 70 because of the long stitches there. As a result, the cross-section of FIG. 11 is taken at that location. The thread is first passed from the inside (FIG. 10) through rear piece 12 and front piece 10 at location 70 along the upper outline 61 of lip 60. The thread is then brought vertically down to a second location 72 slightly above center line 62 where the thread is then passed from front to back through front piece 10 and rear piece 12 (FIG. 10) in that order, leaving a long vertical stitch 74 on the front face of front piece 10. When the needle pulling the thread emerges from the back of rear piece 12, it is pushed back through rear cloth 12 and then front cloth 10 at a third location 76 (FIGS. 9 and 10) adjacent to the second location 72. The thread is then pulled vertically up to create a second long stitch 75, which is immediately adjacent the first mentioned long stitch 74. The needle is then passed at fourth location 78 (FIGS. 9 and 10) through front piece 10 and rear piece 12 in that order. The process is repeated until the entire lip is covered with parallel, vertical threads. One end of the thread passes through the fabric along the top outline 61 of upper lip 60, and the other end of the stitch is passed through the fabric slightly above generally horizontal center line 62. Center line 62 can also curve to show a smile or frown.

After upper lip 60 is completed, lower lip 59 is then made using the same special satin stitch techniques and following outline 63 and a line slightly below center line 62. After the stitching is completed for lower and upper lips 59 and 60, slits 82 and 83 are made in the rear piece of fabric 12 (FIG. 11), and cavities 85 and 86 (FIG. 11) are filled with soft filler material 88. Adjusting the tension of long stitches 64 that form the lips 59 and 60 changes the fullness of the lips.

Lips 59 and 60 are shown to be separate. It is possible to eliminate center line 62 and pass long stitches 64 directly from outline 61 of upper lip to outline 63 of lower lip, but this creates merely a protruding mouth without separate lips and is not as realistic.

FIG. 10 also can be used to illustrate the third embodiment. Rather than forming the outline with special satin stitches of FIG. 9, the outline of the lips is formed by using simple running stitches. FIG. 10 would show how the front and rear pieces of fabric 10 and 12 look after the initial outlining. The space within the outline is filled, leaving protruding lips. Lastly, satin stitches similar to those in FIG. 9 or embroidery is made over the protruding lips and covering the outline stitches. This method creates lips that greatly protrude, and the satin stitches hide the running stitches to yield a pleasing appearance.

After the doll head is completed as described, it can be decorated by further painting eye lashes 90 and eyebrows 91 (FIG. 12). A wig 92 or a hat normally is added to the head. Wig 92 covers the seams that attach back head piece 48 to front and rear pieces 10 and 12. The head is then attached to the rest of the doll body 93.

I claim:

1. A doll face comprising:

a. a front and rear piece of fabric, adhesive means in an outline of a desired feature between the front and rear pieces of fabric holding the front and rear pieces of fabric together and creating a cavity within the outline of the adhesive between the two pieces of fabric;

b. soft material in the form of a batting module having an opening for receiving portions of the front and rear pieces of fabric;

c. wherein the adhesive means is positioned in the opening of the batting module.

2. A method of forming features in fabric comprising:

a. attaching together at least a first region of top and bottom sheets of material with a disk-shaped adhesive of heat fusible material, each of the top and bottom sheets having a periphery, heating at least one of the sheets over the disk to cause the heat fusible material to melt, whereby upon cooling, the heat fusible material causes the first region of the two sheets of material to be attached to each other;

b. stuffing at least a part of an area apart from the first region between the top and bottom sheets with a soft material;

c. closing the periphery of the top and bottom sheets together; and d. encircling the attached first region with a length of thick, elongated material before the step of closing the periphery to form a closed outline around the first region, whereby the top sheet bulges from the thick, elongated material, and area within the outline of the thick, elongated fabric being inset from the outline of the thick, elongated material.

3. The method of claim 2 wherein the length of elongated material has ends and wherein the step of placing the length of thick, elongated material in a closed pattern further comprises the step of attaching the ends of the elongated material together.

4. A doll face comprising:

a. a front and rear piece of fabric, adhesive means in an outline of a desired feature between the front and rear pieces of fabric holding the front and rear pieces of fabric together and creating a cavity within the outline of the adhesive between the two pieces of fabric;

b. soft material in the cavity causing the bulging outward of a portion of the front piece of fabric within the outline of the adhesive; and c. wherein the adhesive means comprises a sheet of heat fusible material with cutouts corresponding to the outline of desired features on the face.

5. A method of creating a fabric doll head comprising:

a. attaching at least a first region of top and bottom sheets of material together with an adhesive to create a cavity, each of the top and bottom sheets having a periphery;

b. cutting a piece of soft material into a module, cutting a hole in the module corresponding to the area of the first region, placing the module over the first region on one of the sheets of material, and pulling the edges of the one sheet of material through the hole and then over the module;

c. closing the periphery of the top and bottom sheets together to create a face, the face having a periphery;

d. attaching the face to a back sheet of fabric, the back sheet having a periphery, the attaching taking place along at least a portion of the peripheries of the face and the back sheet; and e. filling the space between the back piece of fabric and the face with soft material and closing the remainder of the periphery between the front and rear sheets of material and the back piece of fabric to create a doll head.

6. A method of creating a fabric doll head comprising:

a. attaching together at least a first region of top and bottom sheets of material with an adhesive, each of the top and bottom sheets having a periphery;

b. pushing soft material between the two sheets of material at locations away from the first region;

c. closing the periphery of the top and bottom sheets together to create a face, the face having a periphery;

d. attaching the face to a back sheet of fabric, the back sheet having a periphery, the attaching taking place along at least a portion of the peripheries of the face and the back sheet, the back sheet and the bottom sheet facing each other;

e. adding soft material between the back sheet of fabric and the bottom sheet of material and closing the remainder of the periphery between the bottom sheet of material and the back sheet of fabric to create a doll head, the adhesive being a disk of heat fusible adhesive, the step of attaching at least one region of the top and bottom sheets of material together further comprising the step of heating at least one of the sheets over the disk-shaped adhesive to cause the heat fusible material to melt, whereby upon cooling, the heat fusible material causes the region of the two sheets of material to be attached to each other; and f. encircling the attached region with a length of thick, elongated material to form a closed outline around the attached region, whereby the top sheet bulges over the thick, elongated material, and area within the outline of the thick, elongated material is inset from the outline of the thick, elongated material.

7. A method of creating a fabric doll head comprising:

a. attaching together at least one region of top and bottom sheets of material with an adhesive;

b. pushing soft material between the two sheets of material at locations away from the attached region;

c. closing the periphery of the top and bottom sheets together to create a face;

d. attaching the completed face along its periphery to a back sheet of fabric along at least a portion of their peripheries;

e. adding soft material between the back sheet of fabric and the bottom sheet of material and closing the remainder of the periphery between the bottom sheet of material and the back sheet of fabric to create a doll head, the adhesive being a disk of heat fusible adhesive, the step of attaching at least one region of the top and bottom sheets of material together further comprising the step of heating at least one of the sheets over the disk-shaped adhesive to cause the heat fusible material to melt, whereby upon cooling, the heat fusible material causes the region of the two sheets of material to be attached to each other; and f. encircling the attached region with a length of thick, elongated material to form a closed outline around the attached region, whereby the top sheet bulges over the thick, elongated material, and area within the outline of the thick, elongated material is inset from the raised outline of the thick, elongated material.

8. The method of claim 7 wherein the length of thick, elongated material having two ends, and wherein the step of placing the length of thick, elongated material in a closed pattern further comprises the step of attaching the ends of the elongated material together.

9. A method of creating a fabric doll head comprising:

a. attaching together at least a first region of top and bottom sheets of material with an adhesive, each of the top and bottom sheets having a periphery;

b. pushing soft material between the two sheets of material at locations away from the first region;

c. closing the periphery of the top and bottom sheets together to create a face, the face having a periphery;

d. attaching the face to a back sheet of fabric, the back sheet having a periphery, the attaching taking place along at least a portion of the peripheries of the face and the back sheet, the back sheet and the bottom sheet facing each other;

e. adding soft material between the back sheet of fabric and the bottom sheet of material and closing the remainder of the periphery between the bottom sheet of material and the back sheet of fabric to create a doll head, the adhesive being a disk of heat fusible adhesive, the step of attaching at least the first region of the top and bottom sheets of material together further comprising the step of heating at least one of the sheets over the disk-shaped adhesive to cause the heat fusible material to melt, whereby upon cooling, the heat fusible material causes the first region of the two sheets of material to be attached to each other; and f. encircling the first region with a length of thick, elongated material to form a closed outline around the first region, whereby the top sheet bulges over the thick, elongated material, and area within the outline of the thick, elongated material is inset from the outline of the thick, elongated material.

10. A method of forming features in fabric comprising:

a. attaching together at least a first region of top and bottom sheets of material, each of the top and bottom sheets having a periphery;

b. encircling the first region with a length of thick, elongated material to form a closed outline around the first region, the length of thick, elongated material having two ends, whereby the top sheet bulges over the thick, elongated material, and the area of the top sheet within the outline of the thick, elongated material is inset from the outline of the thick, elongated material;

c. stuffing at least a part of the area spaced from the first region between the top and bottom sheets with a soft material; and d. closing a major part of the periphery of the top and bottom sheets by attaching their peripheries together, wherein the step of placing the thick, elongated material in a closed outline further comprises the steps of attaching the ends of the thick, elongated material together.

* * * * *